US007520941B2

(12) United States Patent
Nakamura et al.

(10) Patent No.: US 7,520,941 B2
(45) **Date of Patent: *Apr. 21, 2009**

(54) FUNCTIONALLY GRADED RARE EARTH PERMANENT MAGNET

(75) Inventors: Hajime Nakamura, Echizen (JP); Koichi Hirota, Echizen (JP); Masanobu Shimao, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/340,496

(22) Filed: Jan. 27, 2006

(65) Prior Publication Data

US 2006/0213582 A1 Sep. 28, 2006

(30) Foreign Application Priority Data

Mar. 23, 2005 (JP) ..... 2005-084149

(51) Int. Cl.
*H01F 1/057* (2006.01)
*H01F 1/058* (2006.01)

(52) U.S. Cl. ..... 148/302; 148/301

(58) Field of Classification Search ..... None
See application file for complete search history.

(56) References Cited

U.S. PATENT DOCUMENTS 5,194,099 A * 3/1993 Esper et al. ..... 148/302
5,411,603 A * 5/1995 Vial et al. ..... 148/101
5,766,372 A * 6/1998 Fujimura et al. ..... 148/101
5,858,124 A * 1/1999 Endo et al. ..... 148/302
6,296,720 B1 * 10/2001 Yamamoto et al. ..... 148/302
6,302,939 B1 * 10/2001 Rabin et al. ..... 75/338
6,960,240 B2 * 11/2005 Hirota et al. ..... 75/610
7,053,745 B2 * 5/2006 Yoshimura et al. ..... 335/302
2004/0187970 A1 * 9/2004 Ishizaka et al. ..... 148/302

FOREIGN PATENT DOCUMENTS

EP 1 830 371 A1 9/2007

(Continued)

OTHER PUBLICATIONS

Machine Transaltionof Japanese Patent Document 06-244011.*

(Continued)

*Primary Examiner*—John P. Sheehan
(74) *Attorney, Agent, or Firm*—Westerman, Hattori, Daniels & Adrian, LLP.

(57) ABSTRACT

A functionally graded rare earth permanent magnet is in the form of a sintered magnet body having a composition $R^1_aR^2_bT_cA_dF_eO_fM_g$ wherein the concentration of $R^2/(R^1+R^2)$ contained in grain boundaries surrounding primary phase grains of $(R^1,R^2)_2T_{14}A$ tetragonal system within the sintered magnet body is on the average higher than the concentration of $R^2/(R^1+R^2)$ contained in the primary phase grains, $R^2$ is distributed such that its concentration increases on the average from the center toward the surface of the magnet body, the oxyfluoride of $(R^1,R^2)$ is present at grain boundaries in a grain boundary region that extends from the magnet body surface to a depth of at least 20 μm, and the magnet body includes a surface layer having a higher coercive force than in the interior. The invention provides permanent magnets having improved heat resistance.

5 Claims, 2 Drawing Sheets

FOREIGN PATENT DOCUMENTS

| | | | | |
|---|---|---|---|---|
| JP | 61-195954 | | * | 8/1986 |
| JP | 1-251704 | | * | 10/1989 |
| JP | 3-188241 | | * | 8/1991 |
| JP | 4-184901 | | * | 7/1992 |
| JP | 6-244011 | A1 | | 9/1994 |
| JP | 3471876 | | | 9/2003 |
| JP | 2003-282312 | | | 10/2003 |
| JP | 2004-304038 | | | 10/2004 |
| JP | 2005-11973 | | | 1/2005 |
| WO | 2004/1143333 | A1 | | 12/2004 |
| WO | WO 2005/123974 | A1 | * | 12/2005 |

OTHER PUBLICATIONS

The Journal of the Institute of Electrical Engineers of Japan, vol. 124, 2004, pp. 699-702, published on Nov. 1, 2004.
Press Release (Shin-Etsu News) dated on Mar. 24, 2005.
Intermag Asia 2005; Digest of the IEEE International Magnetics Conference; p. 476; held on Apr. 4-8, 2005.
Techno-Frontier Symposium 2005; pp. B1-2-1 to B1-2-12; held on Apr. 20, 2005 by JMA.
IEEE Transactions on Magnetics, vol. 41, No. 10. Oct. 2005, pp. 3844-3846.
Hwang D. H. et al. "Development of High Coercive Powder From the Nd-Fe-B Sintered Magnet Scrap" IEEE Transactions on Magnetics, IEEE Service Center, New York, NY, US, vol. 40, No. 4, Jul. 2004, pp. 2877-2879.
Extended European Search Report dated Jan. 14, 2008 of European Application No. 06250542.5.
The Journal of the Institute of Electrical Engineers of Japan, vol. 124, 2004, pp. 699-702, published on Nov. 1, 2004.
Press Release (Shin-Etsu News) dated on Mar. 24, 2005.
Intermag Asia 2005; Digest of the IEEE International Magnetics Conference; p. 476; held on Apr. 4-8, 2005.
Techno-Frontier Symposium 2005; pp. B1-2-2 to B1-2-12; held on Apr. 20, 2005 by JMA.
IEEE Transactions on Magnetics, vol. 41, No. 10. Oct. 2005, pp. 3844-3846.
Abstract of Autumn Meeting of Japan Society of Powder and Powder Metallurgy, 2005; p. 143; held on Nov. 14-16, 2005.
2005 BM Symposium, Abstract of Presentation by the Japan Association of Bonded Magnet Industries held on Dec. 2, 2005.
Translation of International Preliminary Report on Patentability mailed May 3, 2007 of International Application No. PCT/JP2005/005134. Associated with copending U.S. Appl. No. 10/572,753.
International Search Report, dated Jun. 28, 2005, International Application No. PCT/JP2005/005134. Associated with copending U.S. Appl. No. 10/572,753.
K. D. Durst et al.; "The Coercive Field of Sintered and Melt-Spun NdFeB Magnets", Journal of Magnetism and Magnetic Materials, 68 (1987), pp. 63-75.
International Search Report of PCT/JP2005/005134 dated JUl. 12, 2005. Associated with copending U.S. Appl. No. 10/572,753.
K. T. Park et al.; "Effects of Metals-Coating and Consecutive Heat Treatment on Coercivity of Thin Nd-Fe-B Sintered Magnets", Proceedings of the Sixteenth International Workshop on Rare-Earth Magnets and Their Applications, Sendai, (2000) pp. 257-264
Copending U.S. Appl. No. 10/572,753 filed on Mar. 21, 2006.

* cited by examiner

FUNCTIONALLY GRADED RARE EARTH PERMANENT MAGNET

CROSS-REFERENCE TO RELATED APPLICATION

This non-provisional application claims priority under 35 U.S.C. §119(a) on Patent Application No. 2005-084149 filed in Japan on Mar. 23, 2005, the entire contents of which are hereby incorporated by reference.

FIELD OF THE INVENTION

This invention relates to high-performance rare earth permanent magnets having a graded function that a surface layer has a higher coercive force than the interior, and efficiently improved heat resistance.

BACKGROUND ART

Because of excellent magnetic properties, Nd—Fe—B permanent magnets find an ever increasing range of application. To meet the recent concern about the environmental problem, the range of utilization of magnets has spread to cover household appliances, industrial equipment, electric automobiles and wind power generators. This requires further improvements in performance of Nd—Fe—B magnets.

The coercive force of Nd—Fe—B magnets declines as the temperature rises. The service temperature of a magnet is thus restricted by the magnitude of coercive force and the permeance of a magnetic circuit. A magnet must have a fully high coercive force in order that the magnet serve at elevated temperature. With respect to the increase of coercive force, there have been proposed many approaches including refinement of crystal grains, use of alloy compositions with increased Nd contents, and addition of effective elements. The current most common approach is to use alloy compositions in which Nd is partially replaced by Dy or Tb. By substituting Dy or Tb for some Nd in $Nd_2Fe_{14}B$ compound, the compound is increased in both anisotropic magnetic field and coercive force. On the other hand, the substitution with Dy or Tb results in the compound having reduced saturation magnetic polarization. Therefore, as long as it is intended to increase the coercive force by this approach, a lowering of remanence is inevitable.

Japanese Patent No. 3,471,876 discloses a rare earth magnet having improved corrosion resistance, comprising at least one rare earth element R, which is obtained by effecting fluorinating treatment in a fluoride gas atmosphere or an atmosphere containing a fluoride gas, to form an $RF_3$ compound or an $RO_xF_y$ compound (wherein x and y have values satisfying $0<x<1.5$ and $2x+y=3$) or a mixture thereof with R in the constituent phase in a surface layer of the magnet, and further effecting heat treatment at a temperature of 200 to 1,200° C.

JP-A 2003-282312 discloses an R—Fe—(B,C) sintered magnet (wherein R is a rare earth element, at least 50% of R being Nd and/or Pr) having improved magnetizability which is obtained by mixing an alloy powder for R—Fe—(B,C) sintered magnet with a rare earth fluoride powder so that the powder mixture contains 3 to 20% by weight of the rare earth fluoride (the rare earth being preferably Dy and/or Tb), subjecting the powder mixture to orientation in a magnetic field, compaction and sintering, whereby a primary phase is composed mainly of $Nd_2Fe_{14}B$ grains, and a particulate grain boundary phase is formed at grain boundaries of the primary phase or grain boundary triple points, said grain boundary phase containing the rare earth fluoride, the rare earth fluoride being contained in an amount of 3 to 20% by weight of the overall sintered magnet. Specifically, an R—Fe—(B,C) sintered magnet (wherein R is a rare earth element, at least 50% of R being Nd and/or Pr) is provided wherein the magnet comprises a primary phase composed mainly of $Nd_2Fe_{14}B$ grains and a grain boundary phase containing the rare earth fluoride, the primary phase contains Dy and/or Tb, and the primary phase includes a region where the concentration of Dy and/or Tb is lower than the average concentration of Dy and/or Tb in the overall primary phase.

These proposals, however, are still insufficient in improving coercive force.

JP-A 2005-11973 discloses a rare earth-iron-boron base magnet which is obtained by holding a magnet in a vacuum tank, depositing an element M or an alloy containing an element M (M stands for one or more rare earth elements selected from Pr, Dy, Tb, and Ho) which has been vaporized or atomized by physical means on the entirety or part of the magnet surface in the vacuum tank, and effecting pack cementation so that the element M is diffused and penetrated from the surface into the interior of the magnet to at least a depth corresponding to the radius of crystal grains exposed at the outermost surface of the magnet, to form a grain boundary layer having element M enriched. The concentration of element M in the grain boundary layer is higher at a position nearer to the magnet surface. As a result, the magnet has the grain boundary layer in which element M is enriched by diffusion of element M from the magnet surface. A coercive force Hcj and the content of element M in the overall magnet have the relationship:

$$Hcj \geqq 1+0.2\times M$$

wherein Hcj is a coercive force in unit MA/m and M is the content (wt %) of element M in the overall magnet and $0.05 \leqq M \leqq 10$. This method, however, is extremely unproductive and impractical.

DISCLOSURE OF THE INVENTION

An object of the present invention is to provide rare earth permanent magnets having a graded function that a surface layer has a higher coercive force than the interior and efficiently improved heat resistance.

In general, a magnet built in a magnetic circuit does not exhibit an identical permeance throughout the magnet, that is, the magnet interior has a distribution of the magnitude of diamagnetic field. For example, if a plate-shaped magnet has a magnetic pole on a wide surface, the center of that surface receives the maximum diamagnetic field. Furthermore, a surface layer of the magnet receives a large diamagnetic field as compared with the interior. Accordingly, when the magnet is exposed to high temperature, demagnetization occurs from the surface layer. Regarding R—Fe—B sintered magnets (wherein R is one or more elements selected from rare earth elements inclusive of Sc and Y), typically Nd—Fe—B sintered magnets, the inventors have found that when Dy and/or Tb and fluorine are absorbed and infiltrated in the magnet from its surface, Dy and/or Tb and fluorine are enriched only in proximity to interfaces between grains to impart a graded function that the coercive force becomes higher in the surface layer than in the interior, and especially the coercive force increases from the interior toward the surface layer. As a consequence, heat resistance is efficiently improved.

Accordingly, the present invention provides a functionally graded rare earth permanent magnet in the form of a sintered magnet body having an alloy composition $R^1{}_aR^2{}_bT_cA_dF_eO_fM_g$ wherein $R^1$ is at least one element selected from rare earth elements inclusive of Sc and Y and exclusive of Tb and Dy, $R^2$ is one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface. Grain boundaries surround primary phase grains of $(R^1,R^2)_2T_{14}A$ tetragonal system within the sintered magnet body. The concentration of $R^2/(R^1+R^2)$ contained in the grain boundaries is on the average higher than the concentration of $R^2/(R^1+R^2)$ contained in the primary phase grains. $R^2$ is distributed such that its concentration increases on the average from the center toward the surface of the magnet body. The oxyfluoride of $(R^1,R^2)$ is present at grain boundaries in a grain boundary region that extends from the magnet body surface to a depth of at least 20 μm. The magnet body includes a surface layer having a higher coercive force than in the magnet body interior.

In a preferred embodiment, the oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

In preferred embodiments, $R^1$ comprises at least 10 atom % of Nd and/or Pr; T comprises at least 60 atom % of iron; and A comprises at least 80 atom % of boron.

The permanent magnet of the invention has a magnetic structure that the coercive force of a surface layer is higher than in the interior, and efficiently improved heat resistance.

DESCRIPTION OF THE PREFERRED EMBODIMENTS

Figure 1:
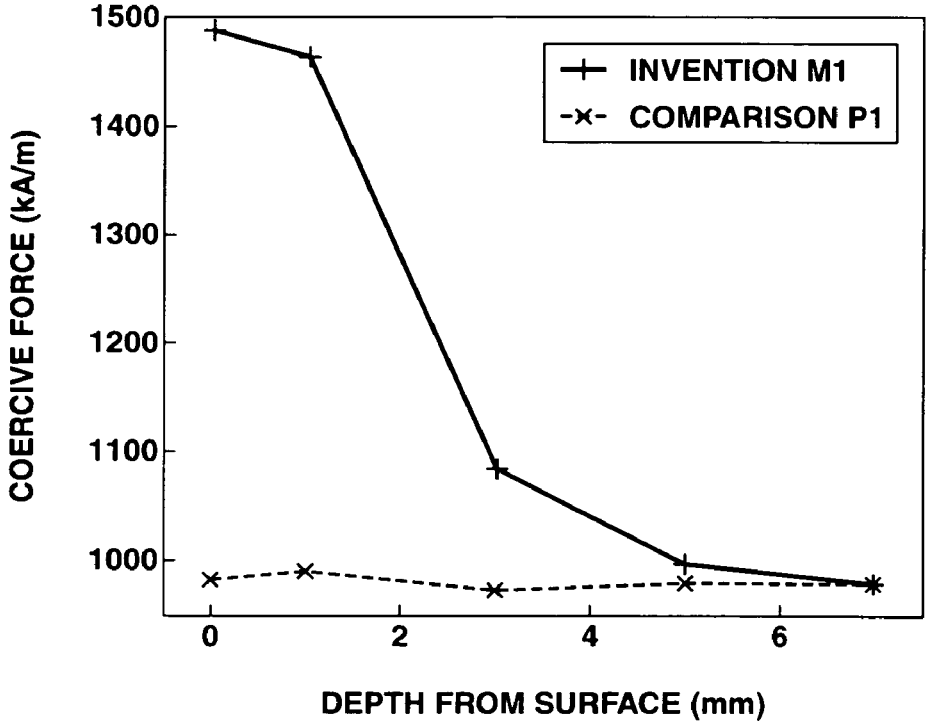
FIG. 1 is a graph in which the coercive force at varying sites of a magnet body M1 manufactured in Example 1 and a magnet body P1 as machined and heat treated is plotted relative to a depth from the magnet surface.

The rare earth permanent magnet of the present invention is in the form of a sintered magnet body having an alloy composition of the formula (1).

$$R^1{}_aR^2{}_bT_cA_dF_eO_fM_g \quad (1)$$

Herein $R^1$ is at least one element selected from rare earth elements inclusive of Sc and Y and exclusive of Tb and Dy, $R^2$ is one or both of Tb and Dy, T is one or both of iron (Fe) and cobalt (Co), A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The subscripts a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c.

Specifically, $R^1$ is selected from among Sc, Y, La, Ce, Pr, Nd, Sm, Eu, Gd, Ho, Er, Yb, and Lu. Desirably, $R^1$ contains Nd and/or Pr as a main component, the content of Nd and/or Pr being preferably at least 10 atom %, more preferably at least 50 atom % of $R^1$. $R^2$ is one or both of Tb and Dy.

The total amount (a+b) of $R^1$ and $R^2$ is 10 to 15 atom %, as recited above, and preferably 12 to 15 atom %. The amount (b) of $R^2$ is preferably 0.01 to 8 atom %, more preferably 0.05 to 6 atom %, and even more preferably 0.1 to 5 atom %.

The amount (c) of T, which is Fe and/or Co, is preferably at least 60 atom %, and more preferably at least 70 atom %. Although cobalt can be omitted (i.e., 0 atom %), cobalt may be included in an amount of at least 1 atom %, preferably at least 3 atom %, more preferably at least 5 atom % for improving the temperature stability of remanence or other purposes.

Preferably A, which is boron and/or carbon, contains at least 80 atom %, more preferably at least 85 atom % of boron. The amount (d) of A is 3 to 15 atom %, as recited above, preferably 4 to 12 atom %, and more preferably 5 to 8 atom %.

The amount (e) of fluorine is 0.01 to 4 atom %, as recited above, preferably 0.02 to 3.5 atom %, and more preferably 0.05 to 3.5 atom %. At too low a fluorine content, an enhancement of coercive force is not observable. Too high a fluorine content alters the grain boundary phase, leading to a reduced coercive force.

The amount (f) of oxygen is 0.04 to 4 atom %, as recited above, preferably 0.04 to 3.5 atom %, and more preferably 0.04 to 3 atom %.

The amount (g) of other metal element M is 0.01 to 11 atom %, as recited above, preferably 0.01 to 8 atom %, and more preferably 0.02 to 5 atom %. The other metal element M may be present in an amount of at least 0.05 atom %, and especially at least 0.1 atom %.

It is noted that the sintered magnet body has a center and a surface. In the invention, constituent elements F and $R^2$ are distributed in the sintered magnet body such that their concentration increases on the average from the center of the magnet body toward the surface of the magnet body. Specifically, the concentration of F and $R^2$ is highest at the surface of the magnet body and gradually decreases toward the center of the magnet body. Fluorine may be absent at the magnet body center because the invention merely requires that the oxyfluoride of $R^1$ and $R^2$, typically $(R^1{}_{1-x}R^2{}_x)OF$ (wherein x is a number of 0 to 1) be present at grain boundaries in a grain boundary region that extends from the magnet body surface to a depth of at least 20 μm. While grain boundaries surround primary phase grains of $(R^1,R^2)_2T_{14}A$ tetragonal system within the sintered magnet body, the concentration of $R^2/(R^1+R^2)$ contained in the grain boundaries is on the average higher than the concentration of $R^2/(R^1+R^2)$ contained in the primary phase grains.

In a preferred embodiment, the oxyfluoride of $(R^1,R^2)$ present at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

The rare earth permanent magnet of the invention can be manufactured by causing Tb and/or Dy and fluorine to be absorbed and infiltrated in an R—Fe—B sintered magnet body from its surface. The R—Fe—B sintered magnet body, in turn, can be manufactured by a conventional process including crushing a mother alloy, milling, compacting and sintering.

The mother alloy used herein contains R, T, A, and M. R is at least one element selected from rare earth elements inclusive of Sc and Y. R is typically selected from among Sc, Y, La, Ce, Pr, Nd, Sm, Eu, Gd, Tb, Dy, Ho, Er, Yb, and Lu. Desirably, R contains Nd, Pr and Dy as main components. These rare earth elements inclusive of Sc and Y are preferably present in an amount of 10 to 15 atom %, more preferably 12 to 15 atom % of the overall alloy. More desirably, R contains one or both of Nd and Pr in an amount of at least 10 atom %, especially at least 50 atom % of the entire R. T is one or both of Fe and Co, and Fe is preferably contained in an amount of at least 50 atom %, and more preferably at least 65 atom % of the overall alloy. A is one or both of boron and carbon, and boron is preferably contained in an amount of 2 to 15 atom %, and more preferably 3 to 8 atom % of the overall alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. M may be contained in an amount of 0.01 to 11 atom %, and preferably 0.1 to 5 atom % of the overall alloy. The balance is composed of incidental impurities such as N and O.

The mother alloy is prepared by melting metal or alloy feeds in vacuum or an inert gas atmosphere, typically argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α—Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching or strip casting technique is applicable as well as the above-described casting technique.

The mother alloy is generally crushed to a size of 0.05 to 3 mm, preferably 0.05 to 1.5 mm. The crushing step uses a Brown mill or hydriding pulverization, with the hydriding pulverization being preferred for those alloys as strip cast. The coarse powder is then finely divided to a size of generally 0.2 to 30 μm, preferably 0.5 to 20 μm, for example, by a jet mill using nitrogen under pressure. The oxygen content of the sintered body can be controlled by admixing a minor amount of oxygen with the pressurized nitrogen at this point. The oxygen content of the final sintered body, which is given as the oxygen introduced during the preparation of the ingot plus the oxygen taken up during transition from the fine powder to the sintered body, is preferably 0.04 to 4 atom %, more preferably 0.04 to 3.5 atom %.

The fine powder is then compacted under a magnetic field on a compression molding machine and placed in a sintering furnace. Sintering is effected in vacuum or in an inert gas atmosphere usually at a temperature of 900 to 1,250° C., preferably 1,000 to 1,100° C. The thus sintered magnet contains 60 to 99 vol %, preferably 80 to 98 vol % of the tetragonal $R_2Fe_{14}B$ compound as a primary phase, the balance being 0.5 to 20 vol % of an R-rich phase, 0 to 10 vol % of a B-rich phase, 0.1 to 10 vol % of R oxide, and at least one of carbides, nitrides and hydroxides of incidental impurities or a mixture or composite thereof.

The sintered block is machined into a magnet body of a predetermined shape, after which rare earth elements, typically Tb and/or Dy, and fluorine are absorbed and infiltrated in the magnet body in order to impart the characteristic magnetic structure that the coercive force of a surface layer is higher than in the interior.

Referring to a typical treatment, a powder containing Tb and/or Dy and fluorine atoms is disposed on the surface of the magnet body. The magnet body packed with the powder is heat treated in vacuum or in an atmosphere of inert gas such as Ar or He at a temperature of not higher than the sintering temperature (referred to as Ts), preferably 200° C. to (Ts−5)° C., especially 250° C. to (Ts−10)° C. for about 0.5 to 100 hours, preferably about 1 to 50 hours. Through the heat treatment, Tb and/or Dy and fluorine are infiltrated into the magnet from the surface and the rare earth oxide within the sintered magnet body reacts with fluorine to make a chemical change into an oxyfluoride.

The oxyfluoride of R (rare earth elements inclusive of Sc and Y) within the magnet is typically ROF, although it generally denotes oxyfluorides containing R, oxygen and fluorine that can achieve the effect of the invention including $RO_mF_n$ (wherein m and n are positive numbers) and modified or stabilized forms of $RO_mF_n$ wherein part of R is replaced by a metal element.

The amount of fluorine absorbed in the magnet body at this point varies with the composition and particle size of the powder used, the proportion of the powder occupying the magnet surface-surrounding space during the heat treatment, the specific surface area of the magnet, the temperature and time of the heat treatment although the absorbed fluorine amount is preferably 0.01 to 4 atom %, more preferably 0.05 to 3.5 atom %. From the standpoint of increasing the coercive force of a surface layer, it is further preferred that the absorbed fluorine amount be 0.1 to 3.5 atom %, especially 0.15 to 3.5 atom %. For absorption, fluorine is fed to the surface of the magnet body in an amount of preferably 0.03 to 30 mg/cm$^2$, more preferably 0.15 to 15 mg/cm$^2$ of the surface.

Through the heat treatment, the Tb and/or Dy component also concentrates adjacent to the grain boundaries to augment anisotropy. The total amount of Tb and Dy absorbed in the magnet body is preferably 0.005 to 2 atom %, more preferably 0.01 to 2 atom %, even more preferably 0.02 to 1.5 atom %. For absorption, Tb and Dy are fed to the surface of the magnet body in a total amount of preferably 0.07 to 70 mg/cm$^2$, more preferably 0.35 to 35 mg/cm$^2$ of the surface.

The surface layer of the magnet body thus obtained has a coercive force which is higher than the coercive force of the magnet interior. Although the difference in coercive force between the surface layer and the interior is not critical, the fact that the permeance differs about 0.5 to 30% between the surface layer and the interior suggests that the coercive force of the surface layer should preferably be higher than the coercive force of the magnet body interior (that is disposed at a depth of at least 2 mm from the magnet body surface) by 5 to 150%, more preferably 10 to 150%, even more preferably 20 to 150%.

It is understood that the coercive force of different sites in the magnet body can be determined by cutting the magnet body into discrete small pieces and measuring the magnetic properties of the pieces.

The permanent magnet material of the invention has a graded function that the coercive force of a surface layer is higher than that of an interior and can be used as a permanent magnet having improved heat resistance, especially in applications including motors and pickup actuators.

EXAMPLE

Examples of the present invention are given below by way of illustration and not by way of limitation.

Example 1 and Comparative Example 1

An alloy in thin plate form was prepared by using Nd, Cu, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 13.5 atom % Nd, 0.5 atom % Al, 0.4 atom % Cu, 6.0 atom % B, and the balance of Fe.

The alloy was ground to a size of under 30 mesh by the hydriding technique. On a jet mill using nitrogen gas under pressure, the coarse powder was finely divided into a powder with a mass base median diameter of 3.7 μm. While shielding from air, the fine powder was oriented in a magnetic field of 15 kOe under a nitrogen atmosphere and compacted under a pressure of about 1 ton/cm$^2$. While shielding from air, the compact was then transferred to a sintering furnace with an Ar atmosphere where it was sintered at 1,050° C. for 2 hours, obtaining a magnet block. The magnet block was machined on all the surfaces into a disk having a diameter of 20 mm and a thickness (oriented direction) of 14 mm. This magnet body had an average permeance value of 2. The magnet body was successively washed with alkaline solution, deionized water, aqueous acetic acid and deionized water, and dried.

Next, dysprosium fluoride powder having an average particle size of 5 μm was dispersed in ethanol in a mixing proportion of 50 wt %. The magnet body was immersed in the dispersion for 1 minute while sonicating the dispersion at 48 kHz, taken up and immediately dried with hot air. The amount of dysprosium fluoride fed was 0.8 mg/cm$^2$. Thereafter, the packed magnet body was subjected to absorptive treatment in an Ar atmosphere at 900° C. for 1 hour and then aging treatment at 520° C. for 1 hour and quenched, obtaining a magnet body within the scope of the invention. This magnet body is designated M1. For comparison purposes, a magnet body was similarly prepared by effecting heat treatment without the dysprosium fluoride package. This is designated P1.

The magnet bodies M1 and P1 were measured for magnetic properties (remanence Br, coercive force Hcj), with the results shown in Table 1. The compositions of the magnets are shown in Table 2. The magnet M1 of the invention exhibited magnetic properties substantially comparable to the magnet P1 having undergone heat treatment without the dysprosium fluoride package. These magnet bodies were held at different temperatures in the range of 50 to 200° C. for one hour, after which the overall magnetic flux was measured. The temperature at which the overall magnetic flux is reduced 5% from the overall magnetic flux at room temperature (25° C.) is defined as the maximum service temperature. The results are also shown in Table 1. The magnet body M1 had a maximum service temperature which was 20° C. higher than that of the magnet body P1 although they had substantially equal coercive forces.

The magnet bodies M1 and P1 were cut along the oriented direction (14 mm thickness direction) into slices of 0.5 mm thick, of which central portions of 4×4 mm were cut out. The small magnet pieces of 4 mm×4 mm×0.5 mm (thick) were measured for coercive force, which are plotted relative to a distance from the surface of the original magnet body in FIG. 1. The coercive force of magnet body P1 remains constant whereas the coercive force of magnet body M1 is very high at the surface layer and lowers to the same level as P1 in the interior. Since these small magnet pieces represent the coercive force of varying sites from the surface layer to the interior of the magnet body, it is demonstrated that the magnet body M1 of the invention has a distribution of coercive force in the interior, which is highest at the surface layer.

The magnet bodies M1 and P1 were analyzed by electron probe microanalysis (EPMA), with their Dy distribution images being shown in FIGS. 2*a* and 2*b*. Since the source alloy for the magnet is free of Dy, bright contrast spots indicative of the presence of Dy are not found in the image of P1. In contrast, the magnet M1 having undergone absorptive treatment with the dysprosium fluoride package manifests that Dy is enriched only at grain boundaries. In FIG. 3, the average concentrations of Dy and F in the magnet M1 having undergone Dy infiltration treatment are plotted relative to a depth from the surface. It is seen that the concentrations of Dy and F enriched at grain boundaries become lower toward the magnet interior.

Figure 2:
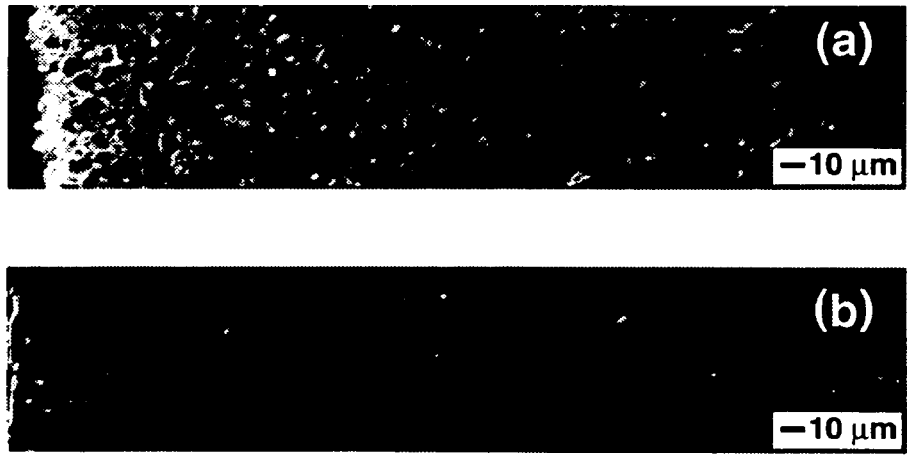
FIGS. 2*a* and 2*b* are photomicrographs showing Dy distribution images of the magnet bodies M1 and P1, respectively.
Figure 3:
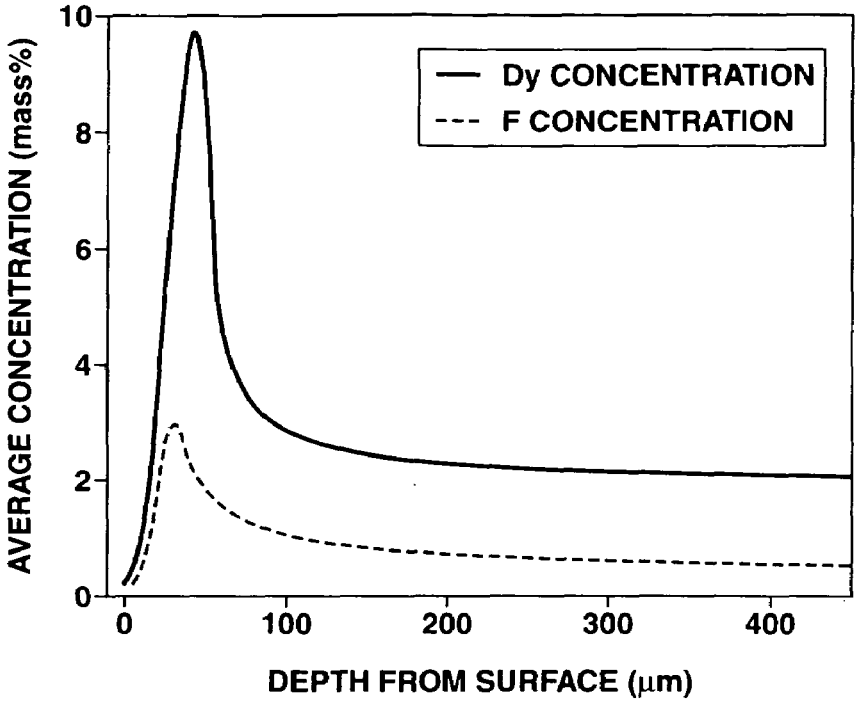
FIG. 3 is a graph in which the average concentrations of Dy and F in the magnet bodies M1 and P1 are plotted relative to a depth from the magnet surface.
Figure 4:
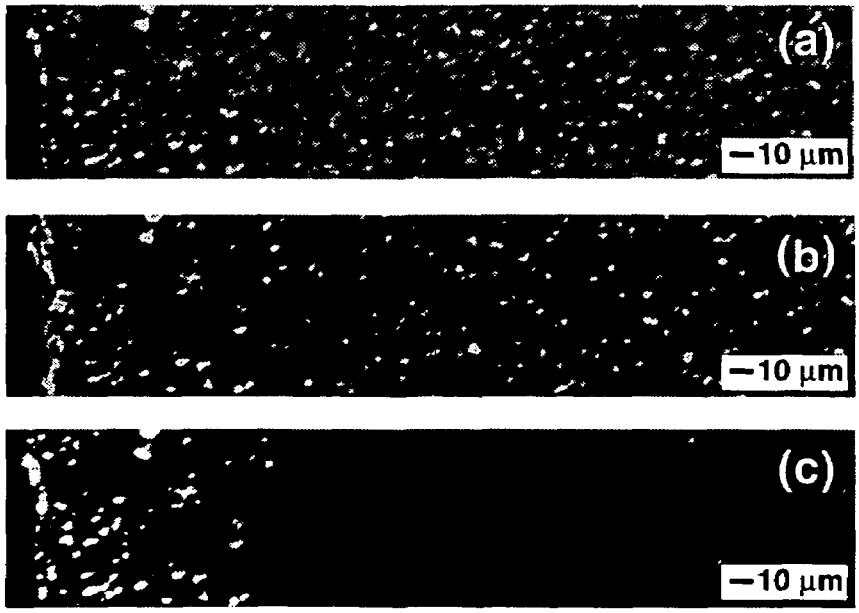
FIGS. 4*a*, 4*b*, and 4*c* are photomicrographs showing compositional distribution images of Nd, O, and F in the magnet body M1, respectively.

FIG. 4 illustrates distribution images of Nd, O and F under the same field of view as in FIG. 2. It is understood that fluorine once absorbed reacts with neodymium oxide already present within the magnet to form neodymium oxyfluoride.

These data prove that a magnet body characterized by the enrichment of Dy at grain boundaries, the dispersion of oxyfluoride, the graded concentrations of Dy and F, and the distribution of coercive force in the interior exhibits better heat resistance with a minimal amount of Dy added.

Example 2 and Comparative Example 2

An alloy in thin plate form was prepared by using Nd, Dy, Cu, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 12.0 atom % Nd, 1.5 atom % Dy, 0.5 atom % Al, 0.4 atom % Cu, 6.0 atom % B, and the balance of Fe.

The alloy was ground to a size of under 30 mesh by the hydriding technique. On a jet mill using nitrogen gas under pressure, the coarse powder was finely divided into a powder with a mass base median diameter of 4.2 μm. While shielding from air, the fine powder was oriented in a magnetic field of 15 kOe under a nitrogen atmosphere and compacted under a pressure of about 1 ton/cm$^2$. While shielding from air, the compact was then transferred to a sintering furnace with an Ar atmosphere where it was sintered at 1,060° C. for 2 hours, obtaining a magnet block. The magnet block was machined on all the surfaces into a disk having a diameter of 10 mm and a thickness (oriented direction) of 7 mm. This magnet body had an average permeance value of 2. The magnet body was successively washed with alkaline solution, deionized water, aqueous nitric acid and deionized water, and dried.

Next, terbium fluoride powder having an average particle size of 10 μm was dispersed in deionized water in a mixing proportion of 50 wt %. The magnet body was immersed in the dispersion for 1 minute while sonicating the dispersion at 48 kHz, taken up and immediately dried with hot air. The amount of terbium fluoride fed was 1.2 mg/cm$^2$. Thereafter, the packed magnet body was subjected to absorptive treatment in an Ar atmosphere at 800° C. for 5 hours and then aging treatment at 510° C. for 1 hour and quenched, obtaining a magnet body within the scope of the invention. This magnet body is designated M2. For comparison purposes, a magnet body was similarly prepared by effecting heat treatment without the terbium fluoride package. This is designated P2.

The magnet bodies M2 and P2 were measured for magnetic properties (Br, Hcj) and the maximum service temperature as defined in Example 1, with the results shown in Table 1. The compositions of the magnets are shown in Table 2. As compared with the magnet P2, the magnet M2 of the invention exhibited a substantially equal remanence, a high coercive force and a maximum service temperature rise of 45° C. The distributions of Tb and F in the magnet bodies M2 and P2 as analyzed by EPMA were equivalent to the distributions of Dy and F in Example 1. The distribution of coercive force of small pieces cut out of the magnet was the same as in Example 1.

These data prove that a magnet body characterized by the enrichment of Tb at grain boundaries, the dispersion of oxyfluoride, the graded concentrations of Tb and F, and the distribution of coercive force in the interior exhibits better heat resistance with a minimal amount of Tb added.

Examples 3-7 and Comparative Examples 3-7

An alloy in thin plate form was prepared by using Nd, Pr, Dy, Al, Fe, Cu, Co, Ni, Mo, Zr, and Ti metals of at least 99 wt % purity and ferroboron, weighing predetermined amounts of them, high-frequency melting them in an Ar atmosphere, and casting the melt onto a single chill roll of copper (strip casting technique). The alloy consisted of 11.5 atom % Nd, 1.0 atom % Pr, 1.0 atom % Dy, 0.5 atom % Al, 0.3 atom % Cu, 1.0 atom % M' (=Cr, Ni, Mo, Zr or Ti), 5.8 atom % B, and the balance of Fe.

The alloy was ground to a size of under 30 mesh by the hydriding technique. On a jet mill using nitrogen gas under pressure, the coarse powder was finely divided into a powder with a mass base median diameter of 5.1 μm. The fine powder was oriented in a magnetic field of 15 kOe under a nitrogen atmosphere and compacted under a pressure of about 1 ton/cm$^2$. The compact was then transferred to a sintering furnace with an Ar atmosphere where it was sintered at 1,060° C. for 2 hours, obtaining a magnet block. The magnet block was machined on all the surfaces into a disk having a diameter of 10 mm and a thickness (oriented direction) of 7 mm. This magnet body had an average permeance value of 2. The magnet body was successively washed with alkaline solution, deionized water, aqueous nitric acid and deionized water, and dried.

Subsequently the magnet body was immersed in a dispersion of 50 wt % a 90:10 (weight ratio) terbium fluoride/neodymium oxide powder mix in ethanol for 1 minute while sonicating the dispersion at 48 kHz. The terbium fluoride and neodymium oxide powders had an average particle size of 10 μm and 1 μm, respectively. The magnet was taken up and placed in a vacuum desiccator where it was dried at room temperature for 30 minutes while evacuating by a rotary pump. The amount of terbium fluoride fed was 1.5 to 2.3 mg/cm$^2$. Thereafter, the packed magnet body was subjected to absorptive treatment in an Ar atmosphere at 900° C. for 3 hours and then aging treatment at 500° C. for 1 hour and quenched, obtaining a magnet body within the scope of the invention. These magnet bodies are designated M3 to M7 in the order of M'=Cr, Ni, Mo, Zr, and Ti. For comparison purposes, magnet bodies were similarly prepared by effecting heat treatment without the powder package. They are designated P3 to P7.

The magnet bodies M3 to M7 and P3 to P7 were measured for magnetic properties (Br, Hcj) and the maximum service temperature as defined in Example 1, with the results shown in Table 1. The compositions of the magnets are shown in Table 2. As compared with the comparative magnets, the magnets M3 to M7 of the invention exhibited substantially equal magnetic properties and a maximum service temperature rise of 20-30° C. The distributions of Tb and F in the magnet bodies M3 to M7 and P3 to P7 as analyzed by EPMA were equivalent to the distributions of Dy and F in Example 1. The distribution of coercive force of small pieces cut out of each magnet was the same as in Example 1.

These data prove that a magnet body characterized by the enrichment of Tb at grain boundaries, the dispersion of oxyfluoride, the graded concentrations of Tb and F, and the distribution of coercive force in the interior exhibits better heat resistance with a minimal amount of Tb added.

TABLE 1

| | | Br (T) | Hcj (MA/m) | Hcj (MA/m) of magnet surface layer | Maximum service temp. (° C.) |
|---|---|---|---|---|---|
| Example 1 | M1 | 1.43 | 0.96 | 1.49 | 115 |
| Example 2 | M2 | 1.39 | 2.08 | 2.47 | 195 |
| Example 3 | M3 | 1.42 | 1.20 | 1.75 | 150 |
| Example 4 | M4 | 1.38 | 1.22 | 1.68 | 140 |
| Example 5 | M5 | 1.37 | 1.25 | 1.61 | 145 |
| Example 6 | M6 | 1.38 | 1.25 | 2.21 | 155 |
| Example 7 | M7 | 1.38 | 1.24 | 2.47 | 150 |
| Comparative Example 1 | P1 | 1.43 | 0.96 | 0.95 | 95 |
| Comparative Example 2 | P2 | 1.39 | 1.35 | 1.37 | 150 |
| Comparative Example 3 | P3 | 1.42 | 1.20 | 1.15 | 120 |
| Comparative Example 4 | P4 | 1.38 | 1.22 | 1.24 | 125 |
| Comparative Example 5 | P5 | 1.37 | 1.24 | 1.20 | 125 |
| Comparative Example 6 | P6 | 1.38 | 1.25 | 1.26 | 130 |
| Comparative Example 7 | P7 | 1.38 | 1.23 | 1.22 | 125 |

TABLE 2

| | | Pr [at. %] | Nd [at. %] | Tb [at. %] | Dy [at. %] | Fe [at. %] | B [at. %] | F [at. %] | O [at. %] | Al [at. %] | Cu [at. %] | M' [at. %] |
|---|---|---|---|---|---|---|---|---|---|---|---|---|
| Example 1 | M1 | 0.000 | 13.228 | 0.000 | 0.061 | 79.183 | 5.969 | 0.179 | 0.485 | 0.497 | 0.398 | 0.000 |
| Example 2 | M2 | 0.000 | 11.739 | 0.082 | 0.000 | 80.598 | 5.959 | 0.240 | 0.489 | 0.497 | 0.397 | 0.000 |
| Example 3 | M3 | 0.969 | 11.195 | 0.163 | 1.013 | 77.695 | 5.703 | 0.478 | 1.014 | 0.492 | 0.295 | 0.983 |
| Example 4 | M4 | 0.971 | 11.222 | 0.123 | 1.015 | 77.844 | 5.717 | 0.359 | 0.974 | 0.493 | 0.296 | 0.986 |
| Example 5 | M5 | 0.976 | 11.276 | 0.062 | 1.019 | 78.161 | 5.745 | 0.181 | 0.798 | 0.495 | 0.297 | 0.990 |
| Example 6 | M6 | 0.964 | 11.145 | 0.288 | 1.010 | 77.461 | 5.678 | 0.842 | 0.849 | 0.489 | 0.294 | 0.979 |
| Example 7 | M7 | 0.960 | 11.099 | 0.338 | 1.006 | 77.187 | 5.654 | 0.990 | 1.011 | 0.487 | 0.292 | 0.975 |
| Comparative Example 1 | P1 | 0.000 | 13.259 | 0.000 | 0.000 | 79.371 | 5.983 | 0.000 | 0.490 | 0.499 | 0.399 | 0.000 |

TABLE 2-continued

| | | Pr [at. %] | Nd [at. %] | Tb [at. %] | Dy [at. %] | Fe [at. %] | B [at. %] | F [at. %] | O [at. %] | Al [at. %] | Cu [at. %] | M' [at. %] |
|---|---|---|---|---|---|---|---|---|---|---|---|---|
| Comparative Example 2 | P2 | 0.000 | 11.786 | 0.000 | 0.000 | 80.844 | 5.983 | 0.000 | 0.490 | 0.499 | 0.399 | 0.000 |
| Comparative Example 3 | P3 | 0.976 | 11.285 | 0.000 | 1.019 | 78.166 | 5.749 | 0.000 | 1.020 | 0.496 | 0.297 | 0.991 |
| Comparative Example 4 | P4 | 0.977 | 11.290 | 0.000 | 1.020 | 78.196 | 5.751 | 0.000 | 0.981 | 0.496 | 0.297 | 0.992 |
| Comparative Example 5 | P5 | 0.979 | 11.310 | 0.000 | 1.022 | 78.339 | 5.762 | 0.000 | 0.800 | 0.497 | 0.298 | 0.993 |
| Comparative Example 6 | P6 | 0.978 | 11.304 | 0.000 | 1.021 | 78.298 | 5.759 | 0.000 | 0.852 | 0.496 | 0.298 | 0.993 |
| Comparative Example 7 | P7 | 0.976 | 11.286 | 0.000 | 1.019 | 78.171 | 5.750 | 0.000 | 1.014 | 0.496 | 0.297 | 0.991 |

Analytical values of rare earth elements were determined by entirely dissolving samples (prepared as in Examples and Comparative Examples) in aqua regia, and effecting measurement by inductively coupled plasma (ICP), analytical values of oxygen determined by inert gas fusion/infrared absorption spectroscopy, and analytical values of fluorine determined by steam distillation/Alfusone colorimetry.

Japanese Patent Application No. 2005-084149 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A functionally graded rare earth permanent magnet in the form of a sintered magnet body having an alloy composition $R^1_aR^2_bT_cA_dF_eO_fM_g$ wherein $R^1$ is at least one element selected from rare earth elements inclusive of Sc and Y and exclusive of Tb and Dy, $R^2$ is one or both of Tb and Dy, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a+b \leqq 15$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface, wherein grain boundaries surround primary phase grains of $(R^1,R^2)_2T_{14}A$ tetragonal system within the sintered magnet body, the concentration of $R^2/(R^1+R^2)$ contained in the grain boundaries is on the average higher than the concentration of $R^2/(R^1+R^2)$ contained in the primary phase grains, $R^2$ is distributed such that its concentration increases on the average from the center toward the surface of the magnet body, an oxyfluoride of $(R^1,R^2)$ is present at grain boundaries in a grain boundary region that extends from the magnet body surface to a depth of at least 20 μm, and the magnet body includes a surface layer having a higher coercive force than in the magnet body interior.

2. The rare earth permanent magnet of claim 1 wherein the oxyfluoride of $(R^1,R^2)$ at grain boundaries contains Nd and/or Pr, and an atomic ratio of Nd and/or Pr to $(R^1+R^2)$ contained in the oxyfluoride at grain boundaries is higher than an atomic ratio of Nd and/or Pr to $(R^1+R^2)$ contained at grain boundaries excluding the oxyfluoride and the oxide of $R^3$ wherein $R^3$ is at least one element selected from rare earth elements inclusive of Sc and Y.

3. The rare earth permanent magnet of claim 1 wherein $R^1$ comprises at least 10 atom % of Nd and/or Pr.

4. The rare earth permanent magnet of claim 1 wherein T comprises at least 60 atom % of iron.

5. The rare earth permanent magnet of claim 1 wherein A comprises at least 80 atom % of boron.

* * * * *